US010145569B2

(12) United States Patent
Thompson et al.

(10) Patent No.: US 10,145,569 B2
(45) Date of Patent: Dec. 4, 2018

(54) AIR HANDLING VENT CONTROL

(71) Applicants: David S. Thompson, Spokane, WA (US); David A. Divine, Spokane, WA (US)

(72) Inventors: David S. Thompson, Spokane, WA (US); David A. Divine, Spokane, WA (US)

( * ) Notice: Subject to any disclaimer, the term of this patent is extended or adjusted under 35 U.S.C. 154(b) by 442 days.

(21) Appl. No.: 14/680,071

(22) Filed: Apr. 7, 2015

(65) Prior Publication Data

US 2015/0292751 A1 Oct. 15, 2015

Related U.S. Application Data

(60) Provisional application No. 61/979,518, filed on Apr. 15, 2014.

(51) Int. Cl.
*F24D 19/10* (2006.01)
*F24H 9/20* (2006.01)
(Continued)

(52) U.S. Cl.
CPC ..... *F24D 19/1084* (2013.01); *F24F 11/008* (2013.01); *F24F 11/0012* (2013.01); *F24F 11/30* (2018.01); *F24F 11/83* (2018.01); *F24F 11/52* (2018.01); *F24F 2011/0038* (2013.01); *F24F 2011/0042* (2013.01);
(Continued)

(58) Field of Classification Search
CPC . F24D 19/1084; F24F 11/0012; F24F 11/008; F24F 2011/0038; F24F 2011/0042; F24F 2011/0056; F24F 2011/0091
See application file for complete search history.

(56) References Cited

U.S. PATENT DOCUMENTS 4,284,236 A * 8/1981 Bradshaw ..... F24F 3/0525 236/49.3
4,530,395 A * 7/1985 Parker ..... F24F 11/72 165/208
(Continued)

OTHER PUBLICATIONS

Suncourt Flush Fit Register Air Booster Fan, https://www.amazon.com/Suncourt-Flush-Fit-Register-Booster/dp/B001WT6S5Y/ref=sr_1_8?ie=UTF8&qid=1495416000&sr=8-8&keywords=furnace+vent+fan, Available at least as early as Apr. 6, 2015, 1 page.
(Continued)

*Primary Examiner* — Ned Landrum
*Assistant Examiner* — Melodee Jefferson

(57) ABSTRACT

Techniques for use with vent covers of furnace ductworks are described herein. A vent cover may include a fan to actively pull air from the ductwork and into a room at least in part in response to a number of open or closed vents in ductwork to which the vent cover is connected. Active air movement through the vent cover may lower air pressure and/or temperature within the ductwork and increase airflow through heat exchangers of the furnace, thereby compensating for zones created by closed vent covers. A system may monitor factors consistent with a furnace over-temperature event, such as furnace operation, closed vent covers, high air pressure or temperature in ductwork, etc. A fan of a vent cover may be turned on to actively draw air through a vent covered by the vent cover. The fan may turn off after conclusion of at least one of the monitored factors.

15 Claims, 4 Drawing Sheets

(51) Int. Cl.

| | |
|---|---|
| ***G05D 23/275*** | (2006.01) |
| ***F24F 11/30*** | (2018.01) |
| ***F24F 11/83*** | (2018.01) |
| ***F24F 11/00*** | (2018.01) |
| *F24F 11/52* | (2018.01) |
| *F24F 110/30* | (2018.01) |
| *F24F 110/10* | (2018.01) |
| *F24F 140/40* | (2018.01) |
| *F24F 110/40* | (2018.01) |

(52) U.S. Cl.

CPC ..... *F24F 2011/0056* (2013.01); *F24F 2011/0091* (2013.01); *F24F 2110/10* (2018.01); *F24F 2110/30* (2018.01); *F24F 2110/40* (2018.01); *F24F 2140/40* (2018.01)

(56) References Cited

U.S. PATENT DOCUMENTS 4,795,088 A * 1/1989 Kobayashi ..... F24F 11/0009 165/217
4,890,666 A * 1/1990 Clark ..... G05D 23/1917 165/208
4,948,040 A * 8/1990 Kobayashi ..... F24F 11/0009 165/217
5,199,385 A * 4/1993 Doss ..... F24H 1/205 110/162
5,219,119 A * 6/1993 Kasper ..... G05D 23/1904 165/239
5,254,034 A * 10/1993 Roth ..... F24F 13/08 454/277
5,524,556 A * 6/1996 Rowlette ..... F23N 1/06 110/159
5,806,440 A * 9/1998 Rowlette ..... F23N 1/06 110/162
6,032,867 A * 3/2000 Dushane ..... G05D 23/1904 236/46 R
6,364,211 B1 4/2002 Saleh
6,692,349 B1 2/2004 Brinkerhoff et al.
7,188,779 B2 * 3/2007 Alles ..... F24F 3/0442 165/205
8,046,896 B2 * 11/2011 Schmitt ..... G06F 1/20 165/104.33
9,032,950 B2 * 5/2015 Schultz ..... F23N 1/022 126/110 A
9,632,490 B2 * 4/2017 Grohman ..... G05B 15/02
9,651,925 B2 * 5/2017 Filbeck ..... G05B 15/02
2004/0238653 A1 * 12/2004 Alles ..... F24F 3/0442 236/49.3
2005/0087614 A1 * 4/2005 Ruise ..... F24F 7/06 236/49.3
2005/0194002 A1 * 9/2005 Henry ..... F23L 1/00 126/99 R
2006/0086814 A1 * 4/2006 Helt ..... F24F 3/14 236/44 A
2006/0286918 A1 * 12/2006 Vargas ..... B60H 1/00871 454/155
2007/0045438 A1 * 3/2007 Wolfson ..... F24F 11/0001 236/49.3
2007/0057078 A1 * 3/2007 Martin ..... F24F 3/0442 236/49.3
2007/0119958 A1 * 5/2007 Kates ..... F24F 11/006 236/1 B
2007/0145160 A1 * 6/2007 Martin ..... F24F 3/0442 236/49.3
2007/0155305 A1 * 7/2007 Heidel ..... F24F 7/06 454/356
2007/0205294 A1 * 9/2007 Byczynski ..... F24F 11/0001 236/44 C
2007/0246553 A1 * 10/2007 Morrow ..... F24F 11/0012 236/46 R
2007/0298706 A1 * 12/2007 Hudon ..... F24F 11/04 454/256
2008/0009237 A1 1/2008 Wu
2008/0033599 A1 * 2/2008 Aminpour ..... F24F 11/30 700/276
2008/0051024 A1 * 2/2008 Caliendo ..... A62C 2/14 454/369
2008/0124667 A1 * 5/2008 Schultz ..... F23N 1/022 431/18
2008/0242212 A1 * 10/2008 El-Galley ..... F24F 7/06 454/258
2009/0065595 A1 * 3/2009 Kates ..... F24F 3/0442 236/49.3
2009/0140059 A1 * 6/2009 Barton ..... F24F 11/0012 236/51
2009/0283603 A1 * 11/2009 Peterson ..... F24F 11/001 236/44 A
2010/0101854 A1 * 4/2010 Wallaert ..... F24F 11/00 174/502
2010/0314941 A1 * 12/2010 Schulzman ..... F04D 25/068 307/40
2011/0269082 A1 * 11/2011 Schultz ..... F23N 1/022 431/12
2012/0253524 A1 * 10/2012 Norrell ..... F24F 13/1426 700/277
2014/0206278 A1 * 7/2014 Stevenson ..... F24F 11/76 454/343
2014/0326796 A1 * 11/2014 Kymissis ..... F24D 19/0087 237/12

OTHER PUBLICATIONS

Deflecto Magnetic Vent Cover, https://www.amazon.com/Deflecto-Magnetic-Cover-Sidewall-MVCX512/dp/B00009W3G4/ref=sr_1_1?ie=UTF8&qid=1495416189&sr=8-1&keywords=furnace+vent+cover, Available at least as early as Apr. 6, 2015, 1 page.

* cited by examiner

AIR HANDLING VENT CONTROL

PRIORITY

This application claims the benefit of U.S. Provisional Application No. 61/979,518, filed Apr. 15, 2014, which is incorporated herein by reference in its entirety.

BACKGROUND

Following the maxims 'bigger is better' or 'be prepared,' a number of homes are constructed or renovated with furnaces that are too large for the home. Additionally, homeowners trying to economize frequently block, close or shut off the vent covers or air registers to one or more rooms in their home, thereby creating cooler zone(s) in some areas and warmer zone(s) in other areas, thereby changing the time of furnace operation. Similarly, evolving technologies are able to automatically open and close the doors on vent covers in one or more rooms, thereby attempting to put heat where and when it is most needed.

In each of these examples, insufficient air may be moved through heat exchangers within the furnace. This can result in the furnace operating at a higher temperature than is preferred, possibly even causing a thermostatically-controlled safety switch to turn the furnace off until it cools.

Accordingly, the foregoing factors, alone or in combination, can result in inadequate airflow through a furnace and potentially overheating of the furnace.

BRIEF DESCRIPTION OF THE DRAWINGS

The detailed description is described with reference to the accompanying figures. In the figures, the left-most digit(s) of a reference number identifies the figure in which the reference number first appears. The same numbers are used throughout the drawings to reference like features and components. Moreover, the figures are intended to illustrate general concepts, and not to indicate required and/or necessary elements.

DETAILED DESCRIPTION

Overview

Figure 1:
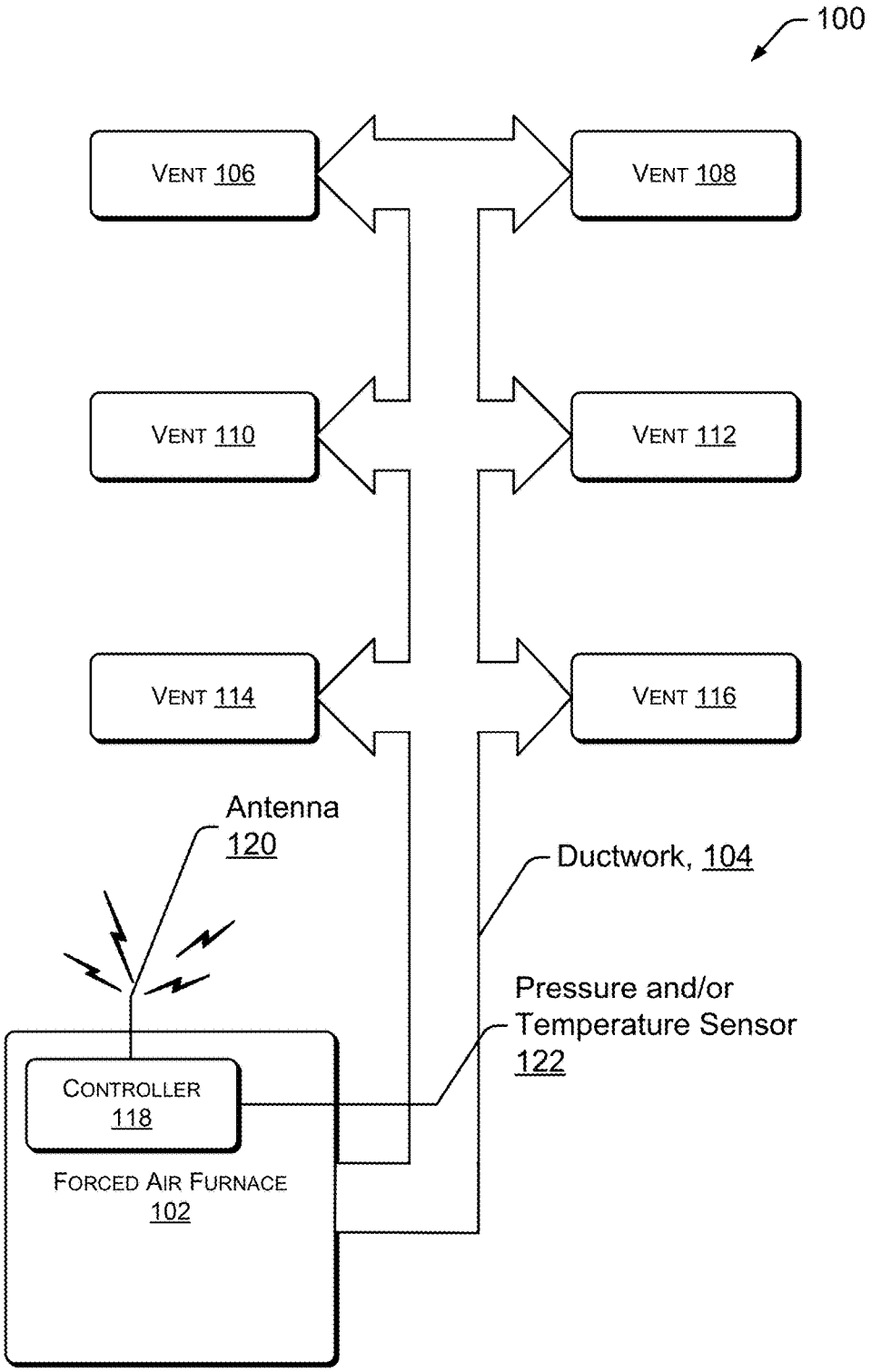
FIG. 1 is diagram showing an example system for furnace operation having a controller to monitor zone heating and protect against furnace overheating.

Systems may utilize techniques described herein to support multiple heating (or air conditioning) zones and to protect an air handling system component, such as a furnace or air conditioner, against overheating or overworking. By fully or partially closing the doors of vent covers of a ductwork connected to a furnace, cooler heating zones may be created. By turning on fans of other vent covers of the ductwork, the airflow through the ductwork may be maintained at a sufficient volume to prevent overheating of a furnace that provides heat through the ductwork to a residence or commercial building. In particular, vent covers with fans increase the volume of air through the ductwork, compensate for reduced airflow due to blocked/closed vents, and provide sufficient air moving through the heat exchanger of a furnace to prevent overheating of the furnace.

In a first example, a vent cover may include a fan to actively pull air from the ductwork and into a room at least in part in response to a number of open or closed vents in ductwork to which the vent cover is connected. Active air movement through the vent cover may lower air pressure and/or temperature within the ductwork and increase airflow through heat exchangers of the furnace, thereby compensating for cooler zone(s) created by closed vent cover(s).

In a second example, a system may monitor factors consistent with preventing a furnace over-temperature event. One factor is whether the furnace is currently in operation (it may not be in current operation if it is allowing the house to cool down, before it turns back on). A second factor is whether any vent covers are closed, thereby fully or partially blocking airflow and creating a cooler heating zone. A third factor is high air pressure or temperature in ductwork. Lower air temperature and lower air pressure indicate that air is not bottled up in the ductwork, and is flowing freely through the heat exchangers of the furnace, to cool the furnace and warm the house. In the example, a fan of a vent cover may be turned on to actively draw air through a vent covered by the vent cover. Such active air transport may compensate for ducts that are fully or partially blocked to create a cooler zone. The fan may turn off after conclusion of at least one of the monitored factors.

In a third example, a controller may monitor one or more aspects of an air handlings system. For instance, the controller may monitor the temperature and/or pressure at one or more locations (e.g., an outlet of a furnace or air conditioner, at one or more air vents or registers, etc.) in the air handling system via one or more temperature and/or pressure sensors, respectively. The system may determine that a condition of the air handling system is outside a predetermined normal operating range and, responsive to the determining that condition of the air handling system is outside the predetermined normal operating range, the controller may actuate a vent cover of the air handling system. For instance, the controller may determine that a pressure at an outlet of a furnace or air conditioner of the air handling system exceeds a normal operating pressure, and may respond by opening the vent cover to alleviate the pressure at the outlet of the furnace or air conditioner. In some instances, the controller may also turn on a fan of the vent cover to actively draw air through the vent cover to further alleviate the pressure at the outlet of the furnace or air conditioner.

In another example, the controller may determine that a temperature at an outlet of a furnace of the air handling system exceeds a normal operating temperature, and may respond by opening the vent cover to increase airflow through the air handling system and thereby reduce the temperature at the outlet of the furnace. In that case, the controller may also respond by turning on a fan of one or more vent covers to actively draw air through the vent cover(s) to further reduce the temperature at a heat exchanger or ductwork of the furnace.

In yet another example, the controller may determine that a pressure at another vent cover of the air handling system is below a normal operating pressure, and may respond by closing the vent cover to increase the pressure at the other vent cover.

In yet another example, the controller may determine that an air flow through a first vent cover of the air handling system is below a normal operating flow rate, and may respond by closing a second vent cover to increase the flow rate through the first vent cover.

In any of the foregoing or other examples, the controller may activate an alarm and/or send a notification responsive to a detecting that a condition is outside a normal operating range. The notification of the condition may comprise, for example, a text message, an email, a voice mail, a message posted to a website or social network, or any other suitable notification.

Example System

A system may support multiple warmer and cooler heating zones and protect a furnace against overheating. Within the system, a first vent cover may include a fan to increase air flow from a ductwork and through the first vent cover. Additionally, a second vent cover may include a door to switch between open and closed states allowing and restricting flow of air. A control system may be configured to turn on the fan in the first vent cover at least when the door of the second vent cover is closed. By turning on the fan in the first vent cover, overall air movement through the ductwork may be maintained, even though the second vent cover is closed. With a fan operating in the first vent cover, and the second vent cover closed, warmer and cooler heating zones are created. In one example, the control system turns off the fan of the first vent cover when the door of the second vent cover is opened. These actions unify the previously created heating zones. Thus, the control system may be configured to balance vent covers with closed doors, vent covers with open doors and vent covers with operating fans to maintain air pressure within the ductwork below a threshold. Over pressure within the ductwork is a sign of inadequate air flow (not enough air is exhausted, resulting in higher air pressure). Inadequate air flow may contribute to overheating of the furnace. Similarly, the control system balances vent covers with closed doors, vent covers with open doors and vent covers with operating fans to maintain air temperature within the ductwork below a threshold and to maintain airflow through the ductwork above a threshold. Thus, the system may consider input including one or more of: a number of closed vent covers; current operation or non-operation of the furnace; airflow volume through the ductwork; air pressure within the ductwork; and/or air temperature within the ductwork. These input factors may indicate the need to turn on or off fans, and/or open or close doors, in one or more vent covers.

FIG. 1 is diagram showing an example system 100 to support multiple heating zones (zones of different temperature) and to protect a furnace against overheating. A furnace 102 is configured to provide heated (or cooled) air into a ductwork 104. The ductwork 104 may be of a particular design and complexity as indicated by a particular application, which may be related to a number and size of rooms, levels, environment, etc., of the home or building to be heated. Heated (or cooled) air moves through the ductwork 104 and exits one or more of the vents (shown as vents 106 through 116 for purposes of illustration, although a greater or lesser number of vents could be used). Each vent 106-116 may be covered by a vent cover that is either separate from, or integrated with, the ductwork 104.

A controller 118 may be located in any desired location, such as: adjacent to, or part of, the furnace 102; adjacent to, or part of, a thermostat controlling the furnace; adjacent to, or part of, one of the vent covers, or in any other convenient location. The controller 118 may be configured to communicate with one or more of the vent covers 106-116, such as by use of RF signals and operation of a radio using antenna 120. The controller may send signals commanding one or more vent covers 106-116 to open and/or close one or more doors, to thereby pass or divert heated (or cooled) air and to create one or more heating/cooling zones. The controller may also send signals commanding one or more vent covers 106-116 to turn on and/or turn off one or more fans, to thereby accelerate heated (or cooled) air through the vent cover(s). With one or more fans operating, airflow through the ductwork 104 may be maintained at levels that approximate the levels associated with each vent having an open door. Moreover, with one or more fans operating, airflow through the ductwork 104 may be maintained at levels that approximate temperature, pressure, and or flow rate of a correctly designed and balanced furnace and ductwork system, despite one or more vents being closed or despite any original design flaws in furnace selection or ductwork design.

A pressure sensor and/or temperature sensor 122 may be positioned within the ductwork 104, typically near the furnace 102. The air pressure and the air temperature within the ductwork 104 can be used as input to determine if sufficient air is moving through the heat exchanger of the furnace 102 to prevent overheating. Higher air temperature and/or pressure tends to indicate that insufficient air is being exhausted from the ductwork 104, and that insufficient air is moving through the furnace.

Figure 2:
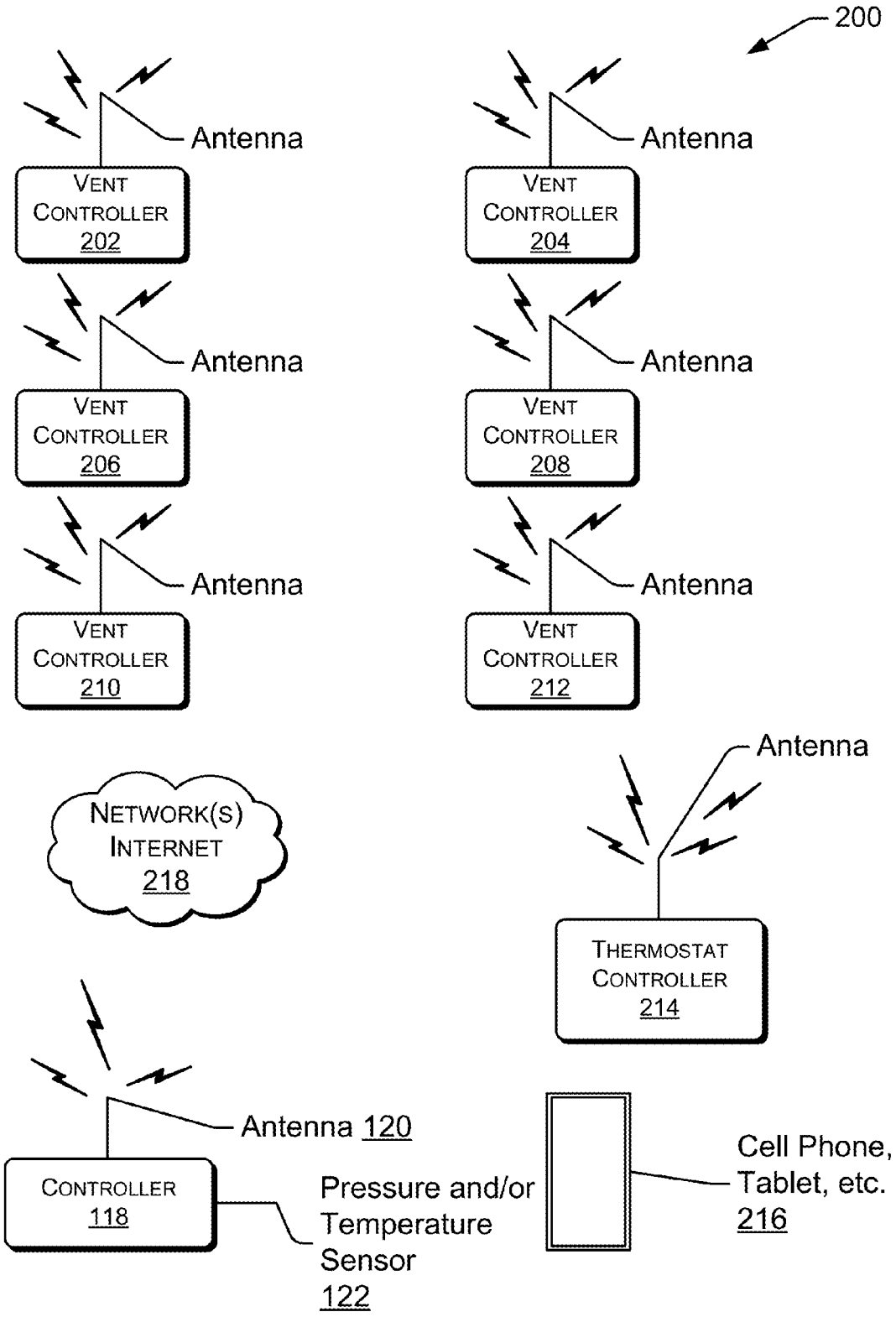
FIG. 2 is diagram showing an example control system.

FIG. 2 is diagram showing an example control system 200. The controller 118 may communicate with one or more vent controllers by means of wired or wireless signal. In the example shown, six vent controllers 202-212 are associated with six vent covers (e.g., vent covers 106-116 of FIG. 1). The controller 118 may command any or all of the vent controllers 202-212 to open or close a vent door or turn on or off a vent fan.

The controller 118 may communicate with a thermostat controller 214. The thermostat controller 214 may turn on or off the furnace according to a set or programmed temperature and/or may control or operate a programmed or timed program, application or routine to provide appropriate heating or cooling at appropriate times of day.

In one example, functionality of the controller 118 and thermostat controller 214 may be merged into a single device. In such a configuration, the pressure/temperature sensor 122 may be required to send data to the combined device, such as by use of an RF channel.

In a further example, a cell phone 216, tablet or other device may communicate over the Internet 218 or other network(s) to provide commands or receive data from the controller 118, thermostat controller 214, or a merged device with the functionality of both devices 118, 214.

Example Vent Cover

A vent cover may include a fan and a controller to turn the fan on and off. The controller may turn the fan of the vent cover on or off at least in part in response to whether other vent covers within ductwork have closed vents. Thus, an operating fan in one or more vent cover(s) may compensate for closed doors in one or more different vent cover(s). Each vent cover may be configurable between three states, including: passive air exhaust through a vent door in an open state; active air exhaust assisted by a fan; and air exhaust blocked by the vent door in a closed state.

Thus, the vent cover may additionally include a door responsive to the controller for movement between an open state and a closed state. The vent cover may additionally include a radio to receive signals to turn the fan on or off. The radio signals may be associated with closing or opening of a door of a second vent cover. That is, the closing or opening of a door of the second vent cover may result in changes in pressure or temperature in the ductwork, which indicate need to turn on or off the fan in the first vent cover.

A system may include the vent cover and an application operable on a computing device, such as the cell phone or tablet 216 of FIG. 2. The application software may provide a user interface to allow a user to control operation of a fan or a door on one or more vent covers. Alternatively, the application may turn on or off fans as needed, to keep air pressure and/or temperature in the ductwork at desired levels.

And further, the application may provide a user with a user interface that allows formation of heating zones by turning on or off vent fans, and by opening and closing vent doors, on any number of vent covers. The application may give the user control over each fan and each door of each vent cover. Alternatively, the application may allow the user to request particular zone(s), and the application will control the doors and fans to achieve the requested zone(s).

Figure 3:
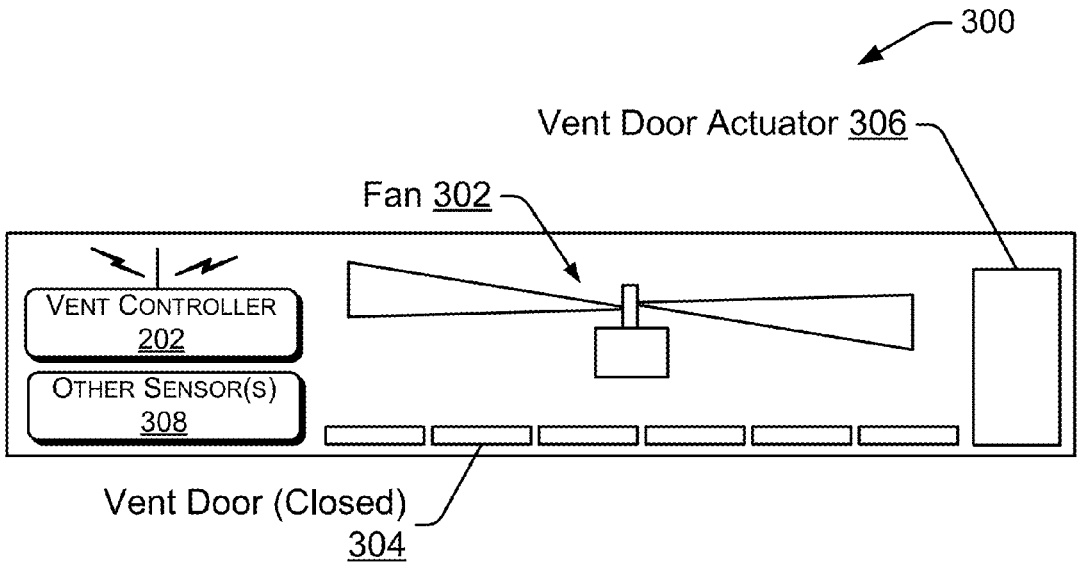
FIGS. 3 and 4 are diagrams of an example vent cover having a fan and doors configurable between open and closed states. A controller controls both the fan and the doors and coordinates with other elements of a system.
Figure 4:
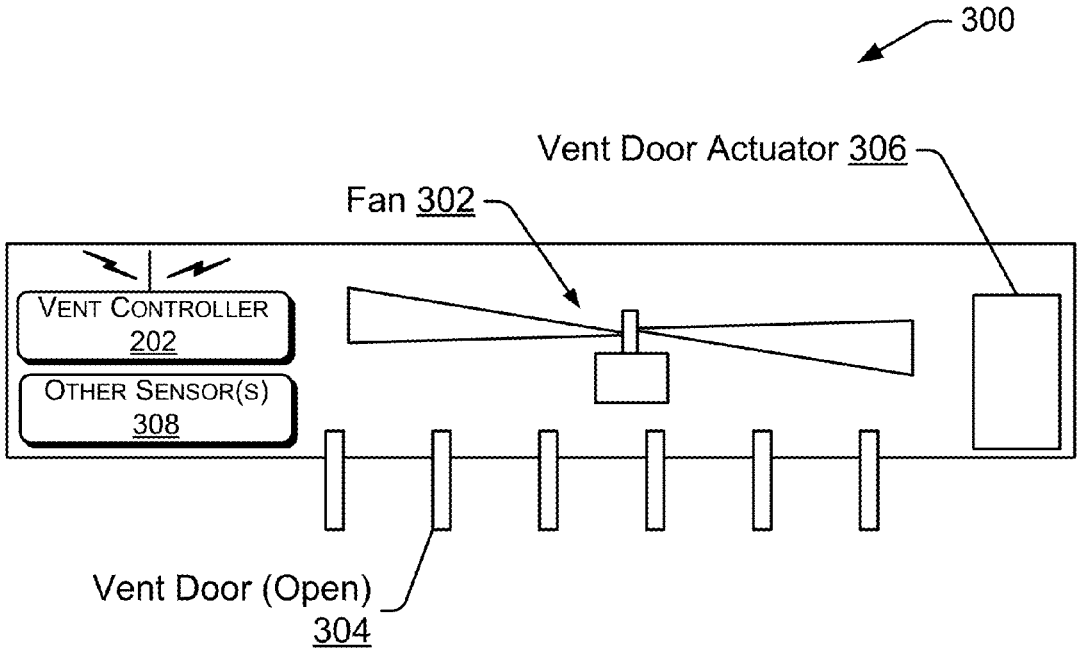

FIGS. 3 and 4 are diagrams of an example vent cover 300 having a fan 302 and doors 304. The doors are configurable between open and closed states by operation of an actuator 306. A controller 202 may control both the fan and the doors. The controller may also communicate with a master controller, such as controller 118, 214 and/or 216 of FIGS. 1 and 2. FIG. 3 shows the door 304 in the closed state, and FIG. 4 shows the door 304 in the open state.

In some examples, the vent cover 300 may additionally or alternatively include one or more other sensors 308 to measure other conditions. For example, the other sensor(s) 308 may include a flow monitor to measure airflow rate through the vent or duct. In some cases, the flow monitor may take advantage of the existence of the fan 302 and may use the fan blade (when not being driven) as a turbine to measure the flow rate of air through the vent or duct. In other cases, the flow monitor may include a separate flow measuring apparatus, such as an anemometer, a thermal flow meter, an ultrasonic flow sensor, or the like. The other sensor(s) 308 may additionally or alternatively include a humidity sensor to measure humidity of the airflow in the vent or duct, a temperature sensor (e.g., thermometer or thermocouple) to measure temperature of the airflow in the vent or duct, a contaminant sensor (e.g., optical sensor, chemical sensors, etc.) to measure contaminants such as allergens and particulate in the airflow, or the like.

Example Methods

In some examples of the techniques discusses herein, the methods of operation may be performed by a processor 502 in any location, such within controller 118 (of FIGS. 1 and 2), controller 214 (of FIG. 2) or computing device 216 (of FIG. 2), etc. The processor/controller may include one or more application specific integrated circuits (ASIC) or may be performed by a general purpose processor utilizing software defined on memory. In the examples and techniques discussed herein, the memory 504 may be located in one or more of controller 118, controller 214 or computing device 216, and may comprise computer-readable media and may take the form of volatile memory, such as random access memory (RAM) and/or non-volatile memory, such as read only memory (ROM) or flash RAM. Computer-readable media includes volatile and non-volatile, removable and non-removable media implemented in any method or technology for storage of information such as computer-readable instructions, data structures, program modules, or other data for execution by one or more processors of a computing device. Examples of computer-readable media include, but are not limited to, phase change memory (PRAM), static random-access memory (SRAM), dynamic random-access memory (DRAM), other types of random access memory (RAM), read-only memory (ROM), electrically erasable programmable read-only memory (EEPROM), flash memory or other memory technology, compact disk read-only memory (CD-ROM), digital versatile disks (DVD) or other optical storage, magnetic cassettes, magnetic tape, magnetic disk storage or other magnetic storage devices, or any other non-transmission medium that can be used to store information for access by a computing device. The other sensor(s) 308 may be communicatively coupled to the controller 202 and may provide input thereto. The controller 202 may use the input from the other sensor(s) 308 alone or in combination with other information (e.g., sensor data or controls from the furnace or thermostat) to control operation of the vent 300.

As defined herein, computer-readable media does not include communication media, such as modulated data signals and carrier waves.

Figure 5:
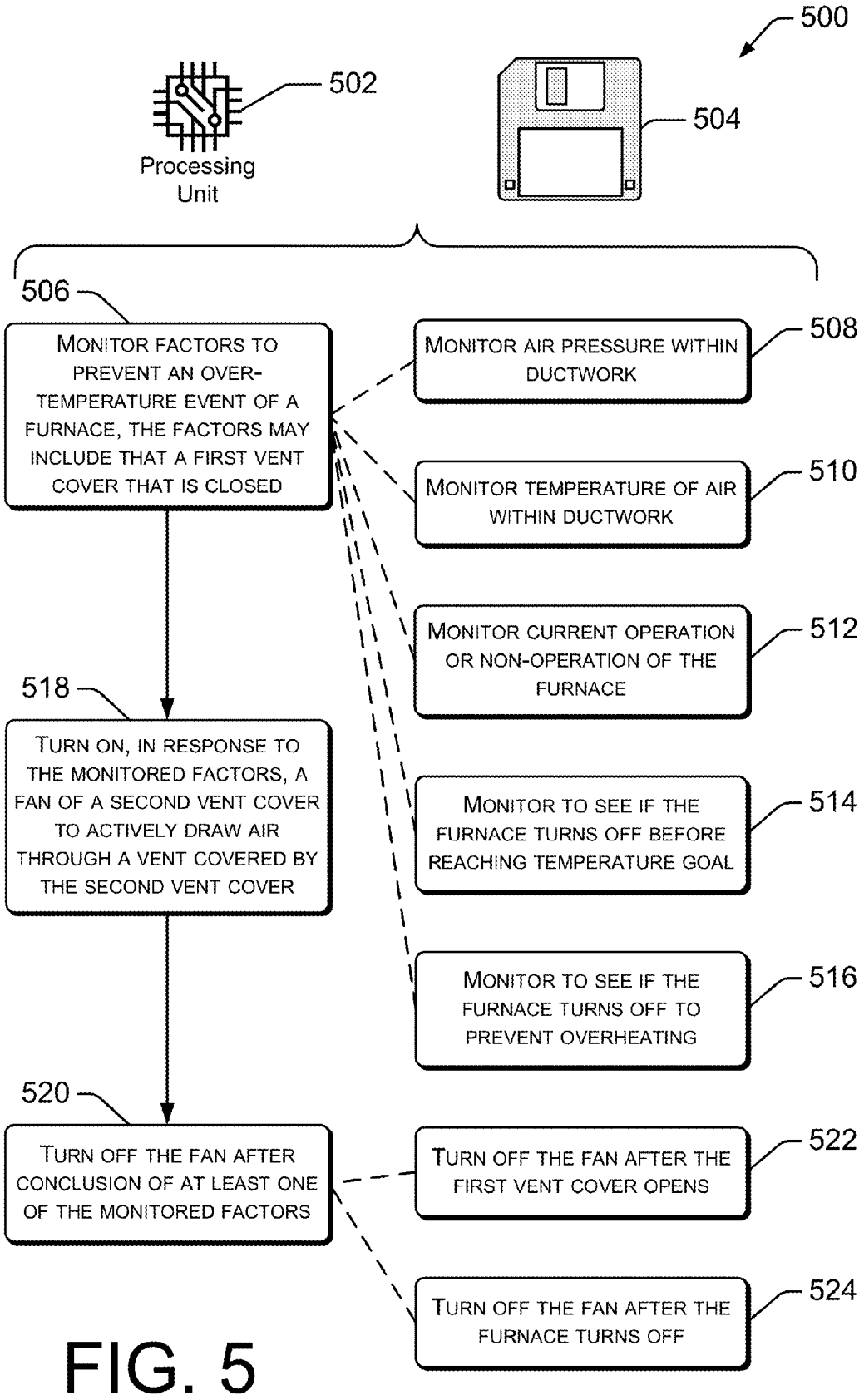
FIG. 5 is a flow diagram showing an example method of operating a system configured to support multiple heating zones and to protect a furnace against overheating.

FIG. 5 is a flow diagram showing an example processes 500 which is representative of techniques to support multiple heating zones and to protect a furnace against overheating. The processes 500 may, but need not necessarily, be implemented in whole or in part by the systems 100 and/or 200 and the vent cover 300. For convenience of explanation and ease of understanding, processes 500 are described with references to the systems 100, 200 and vent cover 300, but are not limited to these environments. Accordingly, the systems 100, 200 and/or vent cover 300 are capable of performing numerous other processes and the processes 500 may be implemented using numerous other systems and devices.

FIG. 5 is a flow diagram showing an example method 500 of operating a system configured to support multiple heating zones and to protect a furnace against overheating. At block 506, factors (e.g., data, input values, information) are monitored that may be used to prevent an over-temperature event of a furnace. The monitoring may be performed by a controller. In the example of FIGS. 1 and 2, one or more of the controllers 118, 214, 216 may monitor and process the input factors/data/input signals. Factors of particular importance include whether or not one or more vent covers (e.g., a first vent cover) are closed. Blocks 508-516 include various example factors/data that may be monitored and/or used. At block 508, air pressure within the ductwork is monitored (e.g., by sensor 122 of FIG. 1). At block 510, temperature of air within the ductwork is monitored (e.g., by sensor 122 of FIG. 1). At block 512, operation of non-operation of the furnace is monitored. For example, if the furnace turns off (e.g., if the house is at the desired temperature) the fan may be turned off. At block 514, the controller may monitor to see if the furnace turns off before reaching a temperature goal. For example, if the thermostat is set at 72 degrees, but the furnace turns off 68 degrees, it may have turned off because the furnace overheated. The overheating may have resulted from inadequate airflow through the furnace heat exchanger and ductwork. At block 516, the controller may monitor to see if the furnace turns off to prevent overheating. In one example, the furnace may send a signal to the controller indicating an overheating event.

At block 518, the controller may turn on—such as in response to calculations or algorithms using one or more of the monitored factors—a fan of a second vent cover. Operation of the fan will actively draw air through a vent covered by (i.e., associated with) the second vent cover.

At block 520, the controller may turn off the fan after conclusion of at least one of the monitored factors. In the example of block 522, the fan is turned off after a door in the first vent cover opens. In the example of block 524, the fan turns off after the furnace turns off.

Example Implementations

In one example, a method, comprising: monitoring factors to prevent an over-temperature event of a furnace, the factors comprising a first vent cover that is closed; turning on, based at least in part on the monitored factors, a fan of a second vent cover to actively draw air through a vent covered by the second vent cover; and turning off the fan based at least in part on conclusion of at least one of the monitored factors. The method, wherein the factors additionally comprise air pressure within ductwork in communication with the first and second vent covers. The method, wherein the factors additionally comprise a temperature of air within ductwork in communication with the first and second vent covers. The method, wherein the factors additionally comprise current operation or non-operation of the furnace. The method, wherein the factors additionally comprise the furnace turning off before reaching a temperature goal. The method, wherein the factors additionally comprise a furnace turning off to prevent overheating of the furnace. The method, wherein the conclusion of at least one of the recognized factors is the opening of the first vent cover. The method, wherein the conclusion of at least one of the recognized factors is the furnace turning off.

In one example, a vent cover, comprising: a fan; and a controller to turn the fan on and off at least in part in response to closed vents in ductwork to which the vent cover is connected. The vent cover as recited, wherein the vent cover is reconfigurable between three states, comprising: passive air exhaust through a vent door in an open state; active air exhaust assisted by a fan; and air exhaust blocked by the vent door in a closed state. The vent cover as recited, additionally comprising a door responsive to the controller for movement between an open state and a closed state. The vent cover as recited, additionally comprising: a radio to receive signals to turn the fan on or off; wherein the radio signals are responsive to closing or opening of a door of a second vent cover. A system comprising the vent cover as recited in claim 9, the system additionally comprising: an application operable on a computing device to provide a user interface to control operation of the fan on the vent cover and to control operation of at least one door on at least one other vent cover, respectively. A system comprising the vent cover as recited in claim 9, the system additionally comprising: an application operable on a computing device to form heating zones associated with closed vent covers and to form heating zones associated with vent covers having fans that are operating.

In one example, a system, comprising: a first vent cover, comprising a fan to increase air flow from a ductwork and through the first vent cover; a second vent cover comprising a door to switch between states allowing and restricting flow of air; and a control system to turn on the fan in the first vent cover at least when the door of the second vent cover is closed. The system, wherein the control system turns the fan off responsive to opening of the door of the second vent cover. The system of claim 15, wherein the control system balances vent covers with closed doors, vent covers with open doors and vent covers with operating fans to maintain air pressure within the ductwork below a threshold. The system of claim 15, wherein the control system balances vent covers with closed doors, vent covers with open doors and vent covers with operating fans to maintain air temperature within the ductwork below a threshold. The system of claim 15, wherein the control system balances vent covers with closed doors, vent covers with open doors and vent covers with operating fans to maintain airflow through the ductwork above a threshold. The system of claim 15, wherein the control system considers as input: a number of closed vent covers; current operation or non-operation of the furnace; and air pressure within the ductwork or air temperature within the ductwork.

In one example, a method, comprising: monitoring an air handling system; determining that a condition of the air handling system is outside a predetermined normal operating range; and responsive to the determining that condition of the air handling system is outside the predetermined normal operating range, actuating a vent cover of the air handling system. The method, wherein the condition comprises a pressure at a location within the air handling system and/or a temperature at a location in the air handling system. The method, wherein: the determining that the condition of the air handling system is outside the predetermined normal operating range comprises determining that a pressure within ductwork of a furnace or air conditioner of the air handling system exceeds a normal operating pressure, and the actuating the vent cover comprises opening the vent cover to alleviate the pressure at the outlet of the furnace or air conditioner. The method, wherein the actuating the vent cover further comprises turning on a fan of the vent cover to actively draw air through the vent cover to further alleviate the pressure at the outlet of the furnace or air conditioner. The method, wherein: the determining that the condition of the air handling system is outside the predetermined normal operating range comprises determining that a temperature at an outlet of a furnace of the air handling system exceeds a normal operating temperature, and the actuating the vent cover comprises opening the vent cover to increase airflow through the air handling system and thereby reduce the temperature at the outlet of the furnace. The method, wherein the actuating the vent cover further comprises turning on a fan of the vent cover to actively draw air through the vent cover to further reduce the temperature at the outlet of the furnace. The method, wherein: the determining that the condition of the air handling system is outside the predetermined normal operating range comprises determining that a pressure at another vent cover of the air handling system is below a normal operating pressure, and the actuating the vent cover comprises closing the vent cover to increase the pressure at the other vent cover. The method, wherein: the determining that the condition of the air handling system is outside the predetermined normal operating range comprises determining that an airflow through another vent cover of the air handling system is below a normal operating flow rate, and the actuating the vent cover comprises closing the vent cover to increase the airflow through the other vent cover. The method, further comprising, responsive to the determining that the condition of the air handling system is outside the predetermined normal operating range, activating an alarm. The method, further comprising, responsive to the determining that the condition of the air handling system is outside the predetermined normal operating range, issuing a notification of the condition. The method, the notification of the condition comprising a text message, an email, a voice mail, a message posted to a website or social network. The method, implemented at least in part by a controller of the air handling system.

CONCLUSION

Although the subject matter has been described in language specific to structural features and/or methodological acts, it is to be understood that the subject matter defined in the appended claims is not necessarily limited to the specific features or acts described. Rather, the specific features and acts are disclosed as exemplary forms of implementing the claims.

What is claimed is:

1. A method, comprising:

monitoring a plurality of vent covers to determine if, for each vent cover, a door of the vent cover is opened or closed;

determining, based at least in part on the monitoring, that at least one door of the plurality of vent covers has been closed;

based at least in part on determining the at least one door of the plurality of vent covers has been closed, and determining an air temperature within ductwork is above a threshold, turning on a fan of a vent cover of the plurality of vent covers with an open door to actively draw air through the vent cover with the open door;

determining, based at least in part on the monitoring, that the at least one door of the plurality of vent covers has been opened; and based at least in part on determining that the at least one door of the plurality of vent covers has been opened, and determining the air temperature within the ductwork is below the threshold, turning off the fan.

2. The method of claim 1, additionally comprising:

detecting an increase in air pressure in the ductwork; and responsive to detecting the increase in air pressure, turning on a fan in another vent cover from among the plurality of vent covers.

3. The method of claim 1, additionally comprising:

detecting an increase in temperature in the ductwork; and responsive to detecting the increase in temperature, turning on a fan in another vent cover from among the plurality of vent covers.

4. The method of claim 1, additionally comprising turning on a fan in another vent cover from among the plurality of vent covers responsive to a change between operation and non-operation of a furnace.

5. The method of claim 1, additionally comprising forming heating zones by closing at least one vent cover from among the plurality of vent covers and turning on a fan in at least one other vent cover from among the plurality of vent covers.

6. The method of claim 1, wherein:

turning on the fan is additionally based at least in part on determining that air pressure within the ductwork is above an air pressure threshold; and turning off the fan is additionally based at least in part on determining that air pressure within the ductwork is below the air pressure threshold.

7. The method of claim 1, wherein:

turning on the fan is additionally based at least in part on determining that air flow within the ductwork is below an airflow threshold; and turning off the fan is additionally based at least in part on determining that air flow within the ductwork is above the airflow threshold.

8. A method, comprising:

monitoring a first vent cover to determine if it is open or closed, wherein the first vent cover covers a first vent in a ductwork attached to a furnace;

determining, based at least in part on the monitoring, that the first vent cover has been closed;

based at least in part on the determining indicating that the first vent cover is closed, and determining that air pressure within the ductwork is above a threshold, turning on a fan of a second vent cover of a second vent defined in the ductwork to actively draw air through the second vent covered by the second vent cover;

determining, based at least in part on the monitoring, that the first vent cover has been opened; and based at least in part on the determining indicating that the first vent cover is open, and determining that air pressure within the ductwork is below the threshold, turning off the fan of the second vent cover.

9. The method of claim 8, wherein turning on the fan of the second vent cover and turning off the fan of the second vent cover is also based at least in part on air flow within ductwork in communication with the first vent cover and the second vent cover.

10. The method of claim 8, wherein turning on the fan of the second vent cover and turning off the fan of the second vent cover is also based at least in part on a temperature of air within ductwork in communication with the first vent cover and the second vent cover.

11. The method of claim 8, wherein turning on the fan of the second vent cover and turning off the fan of the second vent cover is also based at least in part on operation of the furnace.

12. The method of claim 8, additionally comprising turning on a fan of a third vent cover of a third vent to maintain air temperature within the ductwork below a temperature threshold.

13. The method of claim 8, wherein:

turning on the fan is additionally based at least in part on determining that air temperature within the ductwork is above a temperature threshold; and turning off the fan is additionally based at least in part on determining that air temperature within the ductwork is below the temperature threshold.

14. The method of claim 8, wherein:

turning on the fan is additionally based at least in part on determining that airflow within the ductwork is below an airflow threshold; and turning off the fan is additionally based at least in part on determining that airflow within the ductwork is above the airflow threshold.

15. The method of claim 8, additionally comprising:

forming heating zones by closing at least one vent cover and turning on a fan in at least one vent cover.

* * * * *